United States Patent [19]

Diehl et al.

[11] 4,051,046

[45] Sept. 27, 1977

[54] DETERGENT COMPOSITIONS CONTAINING INSOLUBLE PARTICULATE MATERIALS HAVING FABRIC CONDITIONING PROPERTIES

[75] Inventors: Francis Louvaine Diehl, Wyoming; James Byrd Edwards, Roselawn, both of Ohio

[73] Assignee: The Procter & Gamble Company, Cincinnati, Ohio

[21] Appl. No.: 594,909

[22] Filed: July 10, 1975

Related U.S. Application Data

[60] Division of Ser. No. 357,128, May 4, 1973, abandoned, which is a continuation-in-part of Ser. No. 333,103, Feb. 16, 1973, Pat. No. 3,892,681.

[51] Int. Cl.[2] ..... C11D 3/12; C11D 3/14; D06M 11/12

[52] U.S. Cl. ..... 252/8.6; 8/137; 252/116; 252/131; 252/140; 252/155; 252/163

[58] Field of Search ..... 252/112, 113, 115, 116, 252/119, 120, 123, 124, 125, 128, 129, 130, 131, 140, 155, 163, DIG. 2, DIG. 5, DIG. 12, DIG. 14, 8.6; 260/29.6 F, 29.6 PT, 29.6 PM, 33.8 F; 424/78, 81

[56] References Cited

U.S. PATENT DOCUMENTS

| | | | |
|---|---|---|---|
| 2,038,653 | 4/1936 | Gilbert | 252/131 |
| 3,105,051 | 9/1963 | Farrar | 252/107 |
| 3,256,202 | 6/1966 | Weiss | 252/531 |
| 3,522,186 | 7/1970 | Cambre | 252/112 |
| 3,639,290 | 2/1972 | Fearnley | 252/545 |
| 3,645,904 | 2/1972 | Beach | 252/89 |
| 3,658,742 | 4/1972 | Fish | 260/29.6 F |
| 3,746,681 | 7/1973 | McClain | 260/29.6 PM |
| 3,775,052 | 11/1973 | Paassen | 8/137 |
| 3,892,681 | 7/1975 | Edwards | 252/551 |
| 3,910,848 | 10/1975 | Froehlich | 252/90 |
| 3,926,830 | 12/1975 | Horiguchi | 252/135 |

*Primary Examiner*—Dennis L. Albrecht
*Attorney, Agent, or Firm*—Rose Ann Dabek; Jerry J. Yetter; Richard C. Witte

[57] ABSTRACT

Detergent compositions having fabric conditioning properties comprising an organic surface-active agent and low concentrations of substantially water-insoluble particulate material; said compositions imparting anti-wrinkling, ease of ironing, softness, anti-static, and appearance improvements to fabrics treated therewith.

1 Claim, No Drawings

DETERGENT COMPOSITIONS CONTAINING INSOLUBLE PARTICULATE MATERIALS HAVING FABRIC CONDITIONING PROPERTIES

CROSS REFERENCE TO RELATED APPLICATIONS

This is a division, of application Ser. No. 357,128, filed May 4, 1973, now abandoned which is a continuation-in-part of application Ser. No. 333,103, filed February 16, 1973, now issued as U.S. Pat. No. 3,892,681 on July 1, 1975.

BACKGROUND OF THE INVENTION

This invention relates to detergent compositions which comprise in addition to conventional organic surface-active components a substantially water-insoluble particulate material.

Modern detergent compositions, machinery and adjunct chemical additives, e.g., fabric softeners, washing machines and dryers, are haphazardly aimed at achieving benefits other than the obvious goal of rendering a clean wash. Among the benefits sought to be imposed upon the fabrics carried through an entire cycle from washing to drying are fluffiness, softness, body, reduced electrostatic charge, diminished wrinkling, ease of ironing, and improvement in appearance. No single product or machine process is presently available which will achieve all of these benefits simultaneously.

For example, present day fabric softeners impart a softness to the fabric (actually this softness is best likened to a tactile sensation of lubricity, which is distinguishable from fabric softness occasioned by enhanced fabric bulkiness) and control of electrostatic charge. Modern day washing machines and dryers by means of elaborate cycles and temperature control are able to markedly improve the extent of fabric wrinkling. Other products such as wellknown laundry starches, if desired in combination with particulate organic constituents having a melting point below ironing temperatures, impart when applied after the washing cycle, crease permanence and ease of ironing benefits and also imparts a body to the fabric, i.e., a sizing effect.

The detergent compositions of this invention, however, impart all of these benefits simultaneously through the wash. That is, the detergent compositions of this invention, by some imperfectly understood physicochemical interaction at the fiber or yarn level, impart through the wash cycle the above enumerated benefits. These benefits are solely attributable to the presence of water-insoluble particulate material hereinafter defined in combination with organic surface-active agents.

Detergent compositions comprising various particulate materials for the purpose of a specific function are known in the art. Examples thereof are detergent scouring compositions containing water-insoluble particulate materials, which mostly have a particle diameter in the range from about 50 to 100 micrometers and a hardness of about 7 on the Moh scale. It has long been known that gross quantities of starch by means of its gel-forming character impart desirable physical properties to toilet soap bars. Also, the properties of starch as a binding agent, as an agglomerating agent, as a film-forming agent, and as an inert diluent have been exploited in granulated detergent compositions. Starch and starch derivatives have also been used in gross amounts in synthetic detergent compositions to improve the efficiency of the prilling process, that is, formation of the detergent granules from the aqueous medium in which it was either synthesized or resolubilized. Thermoplastic particulate materials are also known in the art and have been used in connection with laundering operations, mainly for the purpose of textile finishing, ease-of-ironing and sizing agents. These materials are softened or fused during e.g. ironing thereby providing a sizing to the fabric. It is also known that some clay materials having exchangeable calcium and magnesium ions can be deposited on fabrics to impart softening properties thereto.

Such clay deposition is usually realized by contacting fabrics to be so treated with aqueous clay suspensions (see for example U.S. Pat. Nos. 3,033,699 and 3,594,221). The copending applications of Storm and Nirschl, Ser. No. 271,943, filed July 14, 1972, now abandoned; Ohren, Ser. No. 279,127, filed Aug. 9, 1972, now U.S. Pat. No. 3,852,211; Nirschl and Gloss, Ser. No. 305,416, filed Nov. 10, 1972, now U.S. Pat. No. 3,862,058; Gloss and Nirschl, Ser. No. 305,417, filed Nov. 10, 1972, now U.S. Pat. No. 3,915,882; Gloss, application Ser. No. 333,104, filed Feb. 16, 1973; and Bernardino, Ser. No. 337,331, filed Mar. 2, 1973, now abandoned relate to the use of clays in detergent and softening compositions.

The prior art teachings, however, aim at achieving specific functions and objectives which, as regards the properties of the particulate materials, i.e., water-insolubility, shape, integrity, particle size diameter, hardness, presence of exchangeable alkaline earth metal ions and melting (softening) temperatures, are essentially different from the physical properties of the water-insoluble particulate materials which qualify for use in the compositions of the instant invention.

In any event, prior art detergent compositions containing the particulate materials referred to hereinbefore do not produce the fabric conditioning benefits of the instant compositions, and in many cases, tend to impart harshness or stiffness to the fabric.

Accordingly, it is an object of the present invention to provide detergent compositions containing water-insoluble particulate materials which impart anti-wrinkling, ease of ironing, fabric softening, anti-static, folding ease, enhanced fabric drapability and appearance benefits to fabrics treated therewith.

It is an additional object of the present invention to provide detergent compositions capable of simultaneously cleaning and conditioning fabrics treated therewith with a view to obtaining a degree of enhanced tactile and appearance properties at least comparable to what results from the use of rinse softeners applied subsequently to conventional washing, i.e., during the rinsing operation.

By utilization of certain particulate materials capable of conferring desirable fabric benefits when present in combination with organic surface-active agents, these above-described objectives can now be attained and detergent compositions formulated which are capable of simultaneously cleaning the fabrics treated therewith and also imparting to these fabrics a series of desirable properties including anti-wrinkling, ease of ironing, fabric softening, anti-static, folding ease, enhanced fabric drapability, and appearance benefits.

SUMMARY OF THE INVENTION

The instant invention provides detergent compositions which are capable of concurrently cleansing and imparting desirable fabric properties to the fabrics treated therewith. Such compositions comprise:

a. from about 2% to about 99.5% by weight of an organic surface-active agent selected from the group consisting of anionic, nonionic, zwitterionic and ampholytic detergents and mixtures thereof; and b. from about 0.05% to about 10% by weight of a substantially water-insoluble particulate material having:

i. an average particle size in the range from about 1 to about 50 micrometers;

ii. a shape having an anisotropy of about 5:1 to 1:1;

iii. a hardness of less than about 5.5 on the Moh scale;

iv. a melting point above about 150° C; and v. substantial freedom from exchangeable calcium and magnesium ions.

In its method aspects, this invention relates to a method for treating fabrics to simultaneously cleanse and impart anti-wrinkling, ease of ironing, softening, anti-static and appearance benefits. Such a method comprises treating fabrics in an aqueous liquor comprising:

a. from about 10 ppm (parts per million) to about 10,000 ppm of an organic surface-active agent selected from the group consisting of anionic, nonionic, zwitterionic and ampholytic detergents and mixtures thereof; and b. from about 0.2 ppm to about 1000 ppm of a substantially water-insoluble particulate material having i. an average particle size in the range from about 1 to about 50 micrometers;

ii. a shape having an anisotropy of about 5:1 to 1:1;

iii. a hardness of less than about 5.5 on the Moh scale;

iv. a melting point above about 150° C; and v. substantial freedom of exchangeable calcium and magnesium ions.

DETAILED DESCRIPTION OF THE INVENTION

The present invention relates to detergent compositions capable of concurrently cleaning and imparting desirable textile properties to fabrics washed therewith.

These compositions comprise: (1) an organic surface-active agent and (2) a substantially water-insoluble particulate material as herein defined.

Unless indicated to the contrary, the "%" indications stand for "% by weight".

The essential organic surface-active component suitable for use in the compositions of the present invention is selected from the group consisting of anionic, nonionic, zwitterionic and ampholytic detergents and mixtures thereof. Said component is to be used in an amount from about 2% to about 99.5%, preferably from about 4% to about 60%, more preferably from about 6% to about 40%.

Examples of suitable surface-active compounds which can be employed in accordance with the present invention include the following:

Anionic Detergents

Water-soluble soaps. Suitable soaps include the sodium, potassium, ammonium and alkanolammonium (e.g., mono-, di-, and triethanolammonium) salts of higher fatty acids ($C_{10}$-$C_{22}$). The sodium and potassium salts of the mixtures of fatty acids derived from coconut oil and tallow, i.e., sodium and potassium tallow and coconut soaps, are particularly useful.

Anionic synthetic detergents also include water-soluble salts, particularly the alkali metal salts, of organic sulfuric reaction products having in their molecular structure an alkyl group containing from about 8 to about 22 carbon atoms and a moiety selected from the group consisting of sulfonic acid and sulfuric acid ester moieties. (Included in the term alkyl is the alkyl portion of higher acyl moieties.) Examples of this group of synthetic detergents which form a part of the preferred built detergent compositions of the present invention are the sodium and potassium alkyl sulfates, especially those obtained by sulfating higher alcohols ($C_8$-$C_{18}$ carbon atoms) produced by reducing glycerides of tallow or coconut oil; sodium and potassium alkyl benzene sulfonates, in which the alkyl group contains from about 9 to about 20 carbon atoms in straight chain or branched-chain configuration, e.g., those of the type described in U.S. Pat. Nos. 2,220,099 and 2,477,383 (especially valuable are linear straight chain alkyl benzene sulfonates in which the average of the alkyl groups is about 11.8 carbon atoms and commonly abbreviated as $C_{11.8}$LAS); sodium alkyl glyceryl ether sulfonates, especially those ethers of higher alcohols derived from tallow and coconut oil; sodium coconut oil fatty acid monoglyceride sulfonates and sulfates; sodium and potassium salts of alkyl phenol ethylene oxide ether sulfates with about 1 to about 10 units of ethylene oxide per molecule and in which the alkyl groups contain from about 8 to about 12 carbon atoms.

Anionic phosphate surfactants are also useful in the present invention. These are surface active materials having substantial detergent capability in which the anionic solubilizing group connecting hydrophobic moieties is an oxy acid of phosphorus. The more common solubilizing groups, of course, are $-SO_4H$ and $-SO_3H$. Alkyl phosphate esters such as $(R-O)_2PO_2H$ and $ROPO_3H_2$ in which R represents an alkyl chain containing from about 8 to about 20 carbon atoms are useful herein.

These phosphate esters can be modified by including in the molecule from one to about 40 alkylene oxide units, e.g., ethylene oxide units. Formulae for these modified phosphate anionic detergents are

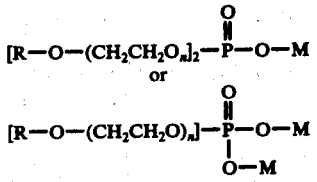

or in which R represents an alkyl group containing from about 8 to 20 carbon atoms, or an alkylphenyl group in which the alkyl group contains from about 8 to 20 carbon atoms, and M represents a soluble cation such as hydrogen, sodium, potassium, ammonium or substituted ammonium; and in which *n* is an integer from 1 to about 40.

Another class of suitable anionic organic detergents useful in this invention includes salts of 2-acyloxyalkane-1-sulfonic acids. These salts have the formula

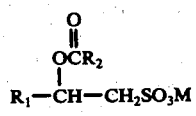

where $R_1$ is alkyl of about 9 to about 23 carbon atoms (forming with the two carbon atoms an alkane group);

$R_2$ is alkyl of 1 to about 8 carbon atoms; and M is a water-soluble cation.

The water-soluble cation, M, in the hereinbefore described structural formula can be, for example, an alkali metal cation (e.g., sodium, potassium, lithium), ammonium or substituted-ammonium cation. Specific examples of substituted ammonium cations include methyl-, dimethyl-, and trimethyl- ammonium cations and quaternary ammonium cations such as tetramethylammonium and dimethyl piperidinium cations and those derived from alkylamines such as ethylamine, diethylamine, triethylamine, mixtures thereof, and the like.

Specific examples of beta-acyloxy-alkane-1-sulfonates, or alternatively 2-acyloxy-alkane-1-sulfonates, useful herein include the sodium salt of 2-acetoxy-tridecane-1-sulfonic acid; the potassium salt of 2-propionyloxy-tetradecane-1-sulfonic acid; the lithium salt of 2-butanoyloxy-tetradecane-1-sulfonic acid; the sodium salt of 2-pentanoyloxy-pentadecane-1-sulfonic acid; the sodium salt of 2-acetoxy-hexadecane-1-sulfonic acid; the potassium salt of 2-octanoyloxy-tetradecane-1-sulfonic acid; the sodium salt of 2-acetoxy-heptadecane-1-sulfonic acid; the lithium salt of 2-acetoxy-octadecane-1-sulfonic acid; the potassium salt of 2-acetoxy-nonadecane-1-sulfonic acid; the sodium salt of 2-acetoxy-uncosane-1-sulfonic acid; the sodium salt of 2-propionyloxy-docosane-1-sulfonic acid; the isomers thereof.

Preferred beta-acyloxy-alkane-1-sulfonate salts herein are the alkali metal salts of beta-acetoxy-alkane-1-sulfonic acids corresponding to the above formula wherein $R_1$ is an alkyl of about 12 to about 16 carbon atoms, these salts being preferred from the standpoints of their excellent cleaning properties and ready availability.

Typical examples of the above described beta-acetoxy alkanesulfonates are described in the literature: Belgium Patent 650,323 issued July 9, 1963, discloses the preparation of certain 2-acyloxy alkanesulfonic acids. Similarly, U.S. Pat. Nos. 2,094,451 issued Sept. 28, 1937, to Guenther, et. al., and 2,086,215 issued July 6, 1937, to DeGroote disclose certain salts of beta-acetoxy alkanesulfonic acids. These references are hereby incorporated by reference.

Another class of anionic detergent compounds herein, both by virtue of superior cleaning properties and low sensitivity to water hardness ($Ca^{++}$ and $Mg^{++}$ ions) are the alkylated α-sulfocarboxylates, containing about 10 to about 23 carbon atoms, and having the formula

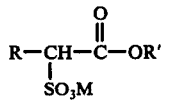

wherein R is $C_8$ to $C_{20}$ alkyl, M is a water-soluble cation as hereinbefore disclosed, preferably sodium ion, and R' is short-chain alkyl, e.g., methyl, ethyl, propyl, and butyl. These compounds are prepared by the esterification of α-sulfonated carboxylic acids, which are commercially available, using standard techniques. Specific examples of the alkylated α-sulfocarboxylates for use herein include:

ammonium methyl-α-sulfopalmitate,
triethanolammonium ethyl-α-sulfostearate,
sodium methyl-α-sulfopalmitate,
sodium ethyl-α-sulfopalmitate,
sodium butyl-α-sulfostearate,
potassium methyl-α-sulfolaurate,
lithium methyl-α-sulfolaurate, as well as mixtures thereof.

Still another class of anionic organic detergents are the β-alkyloxy alkane sulfonates. These compounds have the following formula:

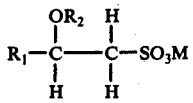

where $R_1$ is a straight chain alkyl group having from 6 to 20 carbon atoms, $R_2$ is a lower alkyl group having from 1 (preferred) to 3 carbon atoms, and M is a water-soluble cation as hereinbefore described.

Specific examples of β-alkyloxy alkane sulfonates, or alternatively 2-alkyloxy-alkane-1-sulfonates, having low hardness (calcium ion) sensitivity useful herein to provide superior cleaning levels under household washing conditions include:

potassium-β-methoxydecanesulfonate,
sodium 2-methoxytridecanesulfonate,
potassium 2-ethoxytetradecylsulfonate,
sodium 2-isopropoxyhexadecylsulfonate,
lithium 2-t-butoxytetradecylsulfonate,
sodium β-methoxyoctadecylsulfonate, and
ammonium β-n-propoxydodecylsulfonate.

Additional examples of anionic non-soap synthetic detergents which come within the terms of the present invention are the reaction product of fatty acids esterified with isethionic acid and neutralized with sodium hydroxide where, for example, the fatty acids are derived from coconut oil; sodium or potassium salts of fatty acid amides of methyl tauride in which the fatty acids, for example, are derived from coconut oil. Other anionic synthetic detergents of this variety are set forth in U.S. Pat. Nos. 2,486,921; 2,486,922; and 2,396,278.

Additional examples of anionic, non-soap, synthetic detergents, which come within the terms of the present invention, are the compounds which contain two anionic functional groups. These are referred to as di-anionic detergents. Suitable di-anionic detergents are the disulfonates, disulfates, or mixtures thereof which may be represented by the following formulae:

$R(SO_3)_2M_2$, $R(SO_4)_2M_2$, $R(SO_3)(SO_4)M_2$, where R is an acyclic aliphatic hydrocarbyl group having 15 to 20 carbon atoms and M is a water-solubilizing cation, for example, the $C_{15}$ to $C_{20}$ disodium 1,2-alkyldisulfates, $C_{15}$ to $C_{20}$ dipotassium-1,2-alkyldisulfonates or disulfates, disodium 1,9-hexadecyl disulfates, $C_{15}$ to $C_{20}$ dipotassium-1,2-alkyldisulfonates or disulfates, disodium 1,9-hexadecyl disulfates, $C_{15}$ to $C_{20}$ disodium-1,2-alkyldisulfonates, disodium 1,9-stearyldisulfates and 6,10-octadecyldisulfates.

The aliphatic portion of the disulfates or disulfonates is generally substantially linear, thereby imparting desirable biodegradable properties to the detergent compound.

The water-solubilizing cations include the customary cations known in the detergent art, i.e., the alkali metals, and the ammonium cations, as well as other metals in group IIA, IIB, IIIA, IVA and IVB of the Periodic Table except for boron. The preferred water-solubilizing cations are sodium or potassium. These dianionic detergents are more fully described in British Pat. No. 1,151,392 which claims priority on an application made in the U.S. Ser. No. 564,556 on July 12, 1966.

Still other anionic synthetic detergents include the class designated as succinamates. This class includes such surface active agents as disodium N-octadecylsulfosuccinamate; tetrasodium N-(1,2-dicarboxyethyl)-N-octadecylsulfo-succinamate; diamyl ester of sodium sulfosuccinic acid; dihexyl ester of sodium sulfosuccinic acid; dioctyl esters of sodium sulfosuccinic acid.

The preferred surface-active agents for use in the compositions of the instant invention include alkyl ether sulfates and "olefin sulfonates".

The preferred alkyl ether sulfates have the formula $$RO(C_2H_4)_xSO_3M$$

wherein R is alkyl or alkenyl of about 10 to about 20 carbon atoms, $x$ is 1 to 30, an M is a salt forming cation such as alkali metal (sodium, lithium, potassium) ammonium, amines and substituted ammonium. Examples of these latter include lower $C_{1-4}$ alkyl amines, and mono, di and trimethanol and ethanolamines.

Especially preferred are those alkyl ether sulfates wherein R has from about 14 to about 18 carbon atoms and wherein $x$ has an average value of about 1 to about 6. Specific examples of especially preferred species are: sodium coconut alkyl ethylene glycol ether sulfate; sodium tallow alkyl triethylene glycol ether sulfate; sodium tallow alkyl pentaoxyethylene sulfate; ammonium tetradecyl pentaoxyethylene sulfate and ammonium lauryl hexaoxyethylene sulfate.

Especially preferred alkyl ether sulfate components have an average (arithmetic mean) carbon chain length within the range of from about 12 to 16 carbon atoms, preferably from about 14 to 15 carbon atoms; and an average (arithmetic mean) degree of ethoxylation of from about 1 to 4 moles of ethylene oxide, preferably from about 2 to 3 moles of ethylene oxide.

Such mixtures comprise from about 0.05% to 5% by weight of mixture of $C_{12-13}$ compounds, from about 55% to 70% by weight of mixture of $C_{14-15}$ compounds, from about 25% to 40% by weight of mixture of $C_{16-17}$ compounds and from about 0.1% to 5% by weight of mixture of $C_{18-19}$ compounds. In addition, such preferred alkyl ether sulfate mixtures comprise from about 15% to 25% by weight of mixture of compounds having a degree of ethoxylation of 0, from about 50% to 65% by weight of mixture of compounds having a degree of ethoxylation from 1 to 4, from about 12% to 22% by weight of mixture of compounds having a degree of ethoxylation from 5 to 8 and from about 0.5% to 10% by weight of mixture of compounds having a degree of ethoxylation greater than 8.

Examples of alkyl ether sulfate mixture falling within the above-specified ranges are set forth in Table I.

TABLE I

| MIXTURE CHARACTERISTIC | ALKYL ETHER SULFATE MIXTURE I | II | III | IV |
|---|---|---|---|---|
| Average carbon chain Length (No. C Atoms) | 14.86 | 14.68 | 14.86 | 14.88 |
| 12–13 carbon atoms (wt. %) | 4% | 1% | 1% | 3% |
| 14–15 carbon atoms (wt. %) | 55% | 65% | 65% | 57% |
| 16–17 carbon atoms (wt. %) | 36% | 33% | 33% | 38% |
| 18–19 carbon atoms (wt. %) | 5% | 1% | 1% | 2% |
| Average degree of ethoxylation (No. Moles EO) | 1.98 | 2.25 | 2.25 | 3.0 |
| 0 moles ethylene oxide (wt. %) | 15% | 21% | 22.9% | 18% |
| 1–4 moles ethylene oxide (wt. %) | 63% | 59% | 65% | 55% |
| 5–8 moles ethylene oxide (wt. %) | 21% | 17% | 12% | 22% |
| 9+ moles ethylene oxide (wt. %) | 1% | 3% | 0.1% | 5% |
| Salt | K | Na | Na | Na |

The preferred "olefin sulfonates" utilizable herein have from about 12 to about 24 carbon atoms. Said ingredients can be produced by sulfonation of α-olefins by means of uncomplexed sulfurdioxide followed by neutralization in conditions such that any sultones present are hydrolyzed to the corresponding hydroxyalkane sulfonates. The α-olefin starting materials preferably have from 14 to 16 carbon atoms. Said preferred α-olefin sulfonates are described in great detail in U.S. Pat. No. 3,332,880, Adriaan Kessler et al., patented July 25, 1967, enclosed herein by reference.

Said α-olefin sulfonates can be represented either by individual species or by mixtures containing structurally different sulfonation products. Preferred mixtures are disclosed by Kessler et al.; one such mixture consists essentially of from about 30% to about 70% by weight of a Component A, from about 20% to about 70% by weight of a Component B, and from about 2% to about 15% of a Component (C), wherein a. said Component A is a mixture of double-bond positional isomers of water-soluble salts of alkene-1-sulfonic acids containing from about 20 to about 24 carbon atoms, said mixture of positional isomers including about 10% to about 25% of an alpha-beta unsaturated isomer, about 30% to about 70% of a beta-gamma unsaturated isomer, about 5% to about 25% of gamma-delta unsaturated isomer, and about 5% to about 10% of a delta-epsilon unsaturated isomer;

b. said Component B is a mixture of water-soluble salts of bifunctionally-substituted sulfur-containing saturated aliphatic compounds containing from about 20 to about 24 carbon atoms, the functional units being hydroxy and sulfonate radicals with the sulfonate radical always being on the terminal carbon and the hydroxyl radical being attached to a carbon atom at least two carbon atoms removed from the terminal carbon atoms at least 90% of the hydroxy radical substitutions being in 3, 4, and 5 positions; and c. said Component C is a mixture comprising from about 30–95% water-soluble salts of alkene disulfonates containing from about 20 to about 24 carbon atoms, and from about 5% to about 70% water-soluble salts of hydroxy disulfonates containing from about 20 to about 24 carbon atoms, said alkene disulfonates containing a sulfonic group attached to a terminal carbon atom and a second sulfonate group attached to an internal carbon atom not more than about six carbon atom removed from said terminal carbon atoms, the alkene double bond being distributed between the terminal carbon atom and about the seventh carbon atoms, said hydroxy disulfonates being saturated aliphatic compounds having a sulfonate radical attached to a terminal carbon, a second sulfonate group attached to an internal carbon atom not more than about six carbon atoms removed from said terminal carbon atom, and a hydroxy group attached to a carbon atom which is not more than about four carbon atoms removed from the site of attachment of said second sulfonate group.

Especially preferred for use in the instant compositions are 3-, 4-, and 5-hydroxy alkyl sulfonates and mixtures thereof. Specific examples of said hydroxy-sulfonates include sodium salts of sodium 3-hydroxy-n-decyl-1-sulfonate,
sodium 3-hydroxy-n-dodecyl-1-sulfonate,
sodium 3-hydroxy-n-tetradecyl-1-sulfonate,
sodium 3-hydroxy-n-hexadecyl-1-sulfonate,
sodium 3-hydroxy-n-octadecyl-1-sulfonate,
sodium 3-hydroxy-n-eicosyl-1-sulfonate,
sodium 3-hydroxy-n-docosyl-1-sulfonate,
sodium 3-hydroxy-n-tetracosyl-1-sulfonate,
sodium 4-hydroxy-n-decyl-1-sulfonate,
sodium 4-hydroxy-n-dodecyl-1-sulfonate,
sodium 4-hydroxy-n-tetradecyl-1-sulfonate,
sodium 4-hydroxy-n-hexadecyl-1-sulfonate,
sodium 4-hydroxy-n-octadecyl-1-sulfonate,
sodium 4-hydroxy-n-eicosyl-1-sulfonate,
sodium 4-hydroxy-n-docosyl-1-sulfonate,
sodium 4-hydroxy-n-tetracosyl-1-sulfonate,
sodium 5-hydroxy-n-decyl-1-sulfonate,
sodium 5-hydroxy-n-dodecyl-1sulfonate,
sodium 5-hydroxy-n-tetradecyl-1-sulfonate,
sodium 5-hydroxy-n-hexadecyl-1-sulfonate,
sodium 5-hydroxy-n-octadecyl-1-sulfonate,
sodium 5-hydroxy-n-eicosyl-1-sulfonate,
sodium 5-hydroxy-n-docosyl-1-sulfonate, and
sodium 5-hydroxy-n-tetracosyl-1-sulfonate.

Among these preferred species the 4-hydroxy substituent is preferred, e.g. for use in combination with 3-hydroxy- and 5-hydroxy-compounds. This means that in a binary system of these, the 4-hydroxy is present in excess of 50% by weight of the active detergent ingredient.

NONIONIC SYNTHETIC DETERGENTS

Most commonly, nonionic surfactants are compounds produced by the condensation of an alkylene oxide (hydrophilic in nature) with an organic hydrophobic compound which is usually aliphatic or alkyl aromatic in nature. The length of the hydrophilic or polyoxyalkylene moiety which is condensed with any particular hydrophobic compound can be readily adjusted to yield a water-soluble compound having the desired degree of balance between hydrophilic and hydrophobic elements. Another type of nonionic surfactants are the so-called polar nonionics derived from amine oxides, phosphine oxides or sulfoxides. Examples of suitable nonionic surfactants include:

1. The polyethylene oxide condensates of alkyl phenols. These compounds include the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds may be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, di-isooctylphenol condensed with about 15 moles of ethylene oxide per mole of phenol. Commercially available nonionic surfactants of this type include Igepal CO-610 marketed by the GAF Corporation; and Triton X-45, X-114, X-100 and X-102, all marketed by the Rohm and Haas Company.

2. The condensation products of aliphatic alcohols with ethylene oxide. The alkyl chain of the aliphatic alcohol may either be straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation, Neodol 23-6.5 marketed by the Shell Chemical Company and Kyro EOB marketed by The Procter & Gamble Company.

3. The condensation products of ethylene oxide with a hydrophobic base formed by the condensation of propylene oxide with propylene glycol. The hydrophobic portion of these compounds has a molecular weight of from about 1500 to 1800 and of course exhibits water insolubility. The addition of polyoxyethylene moieties to this hydrophobic portion tends to increase the water-solubility of the molecule as a whole, and the liquid character of the product is retained up to the point where the polyoxyethylene content is about 50% of the total weight of the condensation product. Examples of compounds of this type include certain of the commercially available Pluoronic surfactants marketed by the Wyandotte Chemicals Corporation.

4. The condensation products of ethylene oxide with the product resulting from the reaction of propylene oxide and ethylene diamine. The hydrophobic base of these products consists of the reaction product of ethylene diamine and excess propylene oxide, said base having a molecular weight of from about 2500 to about 3000. This base is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.

5. Surfactants having the formula $R^1R^2R^3N$-O (amine oxide surfactants) wherein $R^1$ is an alkyl group containing from about 10 to about 28 carbon atoms, from 0 to about 2 hydroxy groups and from 0 to about 5 ether linkages, there being at least one moiety of $R^1$ which is an alkyl group containing from about 10 to about 18 carbon atoms and no ether linkages, and each $R^2$ and $R^3$ is selected from the group consisting of alkyl groups and hydroxyalkyl groups containing from 1 to about 3 carbon atoms;

Specific examples of amine oxide surfactants include: dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis-(2-hydroxyethyl)-3-dodecoxy-1-hydroxypropylamine oxide, (2-hydroxypropyl)methyltetradecylamine oxide, dimethyloleylamine oxide, dimethyl-(2-hydroxydodecyl)amine oxide, and the corresponding decyl, hexadecyl and octadecyl homologs of the above compounds.

6. Surfactants having the formula $R^1R^2R^3P$-O (phosphine oxide surfactants) wherein $R^1$ is an alkyl group containing from about 10 to about 28 carbon atoms, from 0 to about 2 hydroxy groups and from 0 to about 5 ether linkages, there being at least one moiety of $R^1$ which is an alkyl group containing from about 10 to about 18 carbon atoms and no ether linkages, and each $R^2$ and $R^3$ is selected from the group consisting of alkyl groups and hydroxyalkyl groups containing from 1 to about 3 carbon atoms.

Specific examples of the phosphine oxide detergents include: dimethyldodecylphosphine oxide, dimethyltetradecylphosphine oxide, ethylmethyltetradecylphosphine oxide, cetyldimethylphosphine oxide, dimethylstearylphosphine oxide, cetylethylpropylphosphine oxide, diethyldodecylphosphine oxide, diethyltetradecylphosphine oxide, dipropyldodecylphosphine oxide, dipropyldodecylphosphine oxide, bis-(hydroxymethyl)-dodecylphosphine oxide, bis-(2-hydroxyethyl)dodecylphosphine oxide, (2-hydroxypropyl)methyltetradecylphosphine oxide, dimethyloleylphosphine oxide, and dimethyl-(2-hydroxydodecyl)phosphine oxide and the corresponding decyl, hexadecyl, and octadecyl homologs of the above compounds.

7. Surfactants having the formula $$R^1-\overset{\overset{\uparrow}{O}}{S}-R^2$$

(sulfoxide surfactants) wherein $R^1$ is an alkyl group containing from about 10 to about 28 carbon atoms, from 0 to about 5 ether linkages and from 0 to about 2 hydroxyl substituents, at least one moiety of $R^1$ being an alkyl group containing no ether linkages and containing from about 10 to about 18 carbon atoms, and wherein $R^2$ is an alkyl group containing from 1 to 3 carbon atoms and from zero to two hydroxyl groups. Specific examples of sulfoxide surfactants include octadecyl methyl sulfoxide, dodecyl methyl sulfoxide, tetradecyl methyl sulfoxide, 3-hydroxytridecyl methyl sulfoxide, 3-methoxytridecyl methyl sulfoxide, 3-hydroxy-4-dodecoxybutyl methyl sulfoxide, octadecyl 2-hydroxyethyl sulfoxide, and dodecylethyl sulfoxide.

Of all the above-described types of nonionic surfactants, preferred nonionic surfactants include the condensation product of nonyl phenol with about 9.5 moles of ethylene oxide per mole of nonyl phenol, the condensation product of coconut fatty alcohol with about 6 moles of ethylene oxide per mole of coconut fatty alcohol, the condensation product of tallow fatty alcohol with about 11 moles of ethylene oxide per mole of tallow fatty alcohol and the condensation product of a secondary fatty alcohol containing about 15 carbon atoms with about 9 moles of ethylene oxide per mole of fatty alcohol.

Ampholytic Synthetic Detergents

Ampholytic synthetic detergents can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-solubilizing group, e.g., carboxy, sulfonate, sulfato. Examples of compounds falling within this definition are sodium 3-(dodecylamino)propionate, sodium 3-(dodecylamino)-propane-1-sulfonate, sodium 2-(dodecylamino)ethyl sulfate, sodium 2-(dimethylamino)octadeconoate, disodium 3-(N-carboxymethyldodecylamino)-propane-1-sulfonate, disodium octadecyl-iminodiacetate, sodium 1-carboxymethyl-2-undecylimidazole, and sodium N,N-bis(2-hydroxyethyl)-2-sulfato-3-dodecoxypropylamine. Sodium 3-(dodecylamino)propane-1-sulfonate is preferred.

Zwitterionic Synthetic Detergents

Zwitterionic surfactants can be broadly described as derivatives of secondary and tertiary amine, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfato, phosphato, or phosphono. Examples of various classes of zwitterionic surfactants operable herein are described as follows: Compounds corresponding to the general formula $$R_1-\overset{\oplus}{\overset{(R_2)_x}{\overset{|}{Y_1}}}-R_3-Z^{\ominus}$$

wherein $R_1$ is alkyl, alkenyl or a hydroxyalkyl containing from about 8 to about 18 carbon atoms and containing if desired up to about 10 ethylene oxide moieties and/or a glyceryl moiety; $Y_1$ is nitrogen, phosphorous or sulfur, $R_2$ is alkyl or monohydroxyalkyl containing 1 to 3 carbon atoms; $x$ is 1 when $Y_1$ is S, 2 when $Y_1$ is N or P; $R_3$ is alkylene or hydroxyalkylene containing from 1 to about 5 carbon atoms; and Z is a carboxy, sulfonate, sulfate, phosphate or phosphonate group. Examples of this class of zwitterionic surfactants include 3-(N,N-dimethyl-N-hexadecylammonio)-propane-1-sulfonate; 3-(N,N-dimethyl-N-hexadecylammonio)-2-hydroxypropane-1-sulfonate; 2-(N,N-dimethyl-N-dodecylammonio)acetate; 3-(N,N-dimethyl-N-dodecylammonio)-propionate; 2-(N,N-dimethyl-N-octadecylammonio)ethane-1-sulfate; 3-(P,P-dimethyl-P-dodecylphosphonio)propane-1-sulfonate; 2-(S-methyl-S-tert-hexadecylsulfonio)ethane-1-sulfonate; 3-(S-methyl-S-dodecylsulfonio)propionate; 4-(S-methyl-S-tetradecylsulfonio)butyrate; 3-(N,N-dimethyl-N-4-dodecenylammonio)propane-1-sulfonate; 3-(N,N-dimethyl-N-2-diethoxyhexadecylammonio)propane-1-phosphate; and 3-(N,N-dimethyl-N-4-glyceryldodecylammonio)propionate.

Preferred compounds of this class from a commercial standpoint are 3-(N,N-dimethyl-N-hexadecylammonio)-2-hydroxypropane-1-sulfonate; 3-(N,N-dimethyl-N-alkylammonio)-2-hydroxypropane-1-sulfonate, the alkyl group being derived from tallow fatty alcohol; 3-(N,N-dimethyl-N-hexadecylammonio)propane-1-sulfonate; 3-(N,N-dimethyl-N-tetradecylammonio)propane-1-sulfonate; 3-(N,N-dimethyl-N-alkylammonio)-2-hydroxypropane-1-sulfonate, the alkyl group being derived from the middle cut of coconut fatty alcohol; 3-(N,N-dimethyldodecylammonio)-2-hydroxypropane-1-sulfonate; 4-(N,N-dimethyl-tetradecylammonio)butane-1-sulfonate; 4-(N,N-dimethyl-N-hexadecylammonio)butane-1-sulfonate; 4-(N,N-dimethyl-hexadecylammonio)butyrate; 6-(N,N-dimethyl-N-octadecylammonio)hexanoate; 3-(N,N-dimethyl-N-eicosylammonio)-3-methylpropane-1-sulfonate; and 6-(N,N-dimethyl-N-hexadecylammonio)hexanoate.

Means for preparing many of the surfactant compounds of this class are described in U.S. Pat. Nos. 2,129,264, 2,774,786, 2,813,898, 2,828,332 and 3,529,521 and German Pat. No. 1,018,421 all incorporated herein by reference.

Compounds having the general formula:

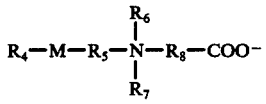

wherein $R_4$ is an alkyl, cycloalkyl, aryl, aralkyl or alkaryl group containing from 10 to 20 carbon atoms; M is a bivalent radical selected from the group consisting of aminocarbonyl, carbonylamino, carbonyloxy, aminocarbonylamino, the corresponding thio groupings and substituted amino derivatives; $R_5$ and $R_8$ are alkylene groups containing from 1 to 12 carbon atoms; $R_6$ is alkyl or hydroxyalkyl containing from 1 to 10 carbon atoms; $R_7$ is selected from the group consisting of $R_6$ groups $R_4$—M—$R_5$–, and —$R_8$COOMe wherein $R_4$, $R_5$, $R_6$ and $R_8$ are as defined above and Me is a monovalent salt-forming cation. Compounds of the type include N,N-bis(oleylamidopropyl)-N-methyl-N-carboxymethylammonium betaine; N,N-bis(stearamidopropyl)-N-methyl-N-carboxymethylammonium betaine; N-(stearamidopropyl)-N-dimethyl-N-carboxymethylammonium betaine; N,N-bis(oleylamidopropyl)-N-(2-hydroxyethyl)-N-carboxymethylammonium betaine; and N-N-bis-(stearamidopropyl)-N-(2-hydroxyethyl)-N-carboxymethylammonium betaine. Zwitterionic surfactants of this type are prepared in accordance with methods described in U.S. Pat. No. 3,265,719 and DAS German Pat. No. 1,018,421.

Compounds having the general formula

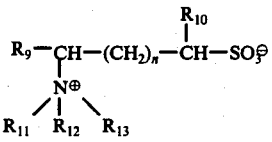

wherein $R_9$ is an alkyl group, $R_{10}$ is a hydrogen atom or an alkyl group, the total number of carbon atoms in $R_9$ and $R_{10}$ being from 8 to 16 and

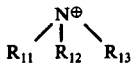

represents a quaternary ammonio group in which each group $R_{11}$, $R_{12}$ and $R_{13}$ is an alkyl or hydroxyalkyl group or the groups $R_{11}$, $R_{12}$ and $R_{13}$ are conjoined in a heterocyclic ring and $n$ is 1 or 2. Examples of suitable zwitterionic surfactants of this type include the $\gamma$ and $\delta$ hexadecyl pyridino sulphobetaines, the $\gamma$ and $\delta$ hexadecyl $\gamma$-picolino sulphobetaines, the $\gamma$ and $\delta$ tetradecyl pyridino sulphobetaines and the hexadecyl trimethylammonio sulphobetaines. Preparation of such zwitterionic surfactants is described in South African patent application No. 69/5788.

Compounds having the general formula

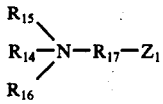

wherein $R_{14}$ is an alkarylmethylene group containing from about 8 to 24 carbon atoms in the alkyl chain; $R_{15}$ is selected from the group consisting of $R_{14}$ groups and alkyl and hydroxyalkyl groups containing from 1 to 7 carbon atoms; $R_{16}$ is alkyl or hydroxyalkyl containing from 1 to 7 carbon atoms; $R_{17}$ is alkylene or hydroxyalkylene containing from 1 to 7 carbon atoms and $Z_1$ is selected from the group consisting of sulfonate, carboxy and sulfate. Examples of zwitterionic surfactants of this type include 3-(N-dodecylbenzyl-N,N-dimethylammonio)propane-1-sulfonate; 4-(N-dodecylbenzyl-N,N-dimethylammonio)butane-1-sulfonate; 3-(N-hexadecylbenzyl-N,N-dimethylammonio)propane-1-sulfonate; 3-(N-dodecylbenzyl-N,N-dimethylammonio)propionate; 4-(N-hexadecylbenzyl-N,N-dimethylammonio)butyrate; 3-(N-tetradecylbenzyl-N,N-dimethylammonio)-propane-1-sulfate; 3-(N-dodecylbenzyl-N,N-dimethylammonio)-2-hydroxypropane-1-sulfonate; 3-[N,N-di(dodecylbenzyl)-N-methylammonio]propane-1-sulfonate; 4-[N,N-di(hexadecylbenzyl)-N-methylammonio]-butyrate; and 3-[N,N-di(tetradecylbenzyl)-N-methylammonio]-2-hydroxypropane-1-sulfonate.

Zwitterionic surfactants of this type as well as methods for their preparation are described in U.S. Pat. Nos. 2,697,116; 2,697,656 and 2,669,991 and Canadian Pat. No. 883,864, all incorporated herein by reference.

Compounds having the general formula

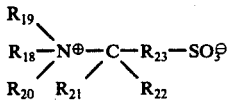

wherein $R_{18}$ is an alkylphenyl, cycloalkylphenyl or alkenylphenyl group containing from 8 to 20 carbon atoms, in the alkyl, cycloalkyl or alkenyl moiety; $R_{19}$ and $R_{20}$ are each aliphatic groups containing from 1 to 5 carbon atoms; $R_{21}$ and $R_{22}$ are each hydrogen atoms, hydroxyl groups or aliphatic groups containing from 1 to 3 carbon atoms and $R_{23}$ is an alkylene group containing from 2 to 4 carbon atoms.

Examples of zwitterionic surfactants of this type include 3-(N-dodecylphenyl-N,N-dimethylammonio)propane-1-sulfonate; 4-(N-hexadecylphenyl-N,N-dimethyl)butane-1-sulfonate; 3-(N-tetradecylphenyl-N,N-dimethylammonio)-3,3-dimethylpropane-1-sulfonate and 3-(N-dodecylphenyl-N,N-dimethylammonio)-3-hydroxypropane-1-sulfonate. Compounds of this type are described more fully in British Pat. Nos. 970,883 and 1,046,252, incorporated herein by reference.

Of all the above-described types of zwitterionic surfactants, preferred compounds include 3(N,N-dimethyl-N-alkylammonio)-propane-1-sulfonate and 3(N,N-dimethyl-N-alkylammonio)-2-hydroxypropane-1-sulfonate wherein in both compounds the alkyl group averages 14.8 carbon atoms in length; 3(N,N-dimethyl-N-hexadecylammonio)propane-1-sulfonate; 3(N,N-dimethyl-N-hexadecylammonio)-2-hydroxypropane-1-sulfonate; 3-(N-dodecylbenzyl-N,N-dimethylammonio)-propane-1-sulfonate; (N-dodecylbenzyl-N,N-dimethylammonio)acetate; 3-(N-dodecylbenzyl-N,N-dimethylammonio)propionate; 6-(N-dodecylbenzyl-N,N-dimethylammonio)hexanoate; and (N,N-dimethyl-N-hexadecylammonio)acetate.

The operable substantially water-insoluble particulate component for use in the compositions of the instant invention is identified by a series of characteristics; namely, (1) an average particle size from about 1.0 to about 50, preferably from about 5 to about 30 micrometers; (2) a shape having an anisotropy of about 5:1 to 1:1; (3) a hardness of less than about 5.5 on the Moh scale; (4) a melting (softening) temperature above about 150° C; and (5) substantial freedom from exchangeable calcium and magnesium ions.

Said particulate component is used in the instant compositions in an amount from about 0.05% to about 10%, preferably from about 0.1% to about 6%, more preferably, from about 0.2% to about 4%. Above the upper limit, the previously enumerated fabric benefits can be diminished or even eliminated to the extent that undesirable stiffness and harshness to fabrics treated with the instant compositions occurs.

The average particle size of the substantially water-insoluble particulate component is within the range from about 1 to about 50, preferably from about 5 to about 30 micrometers. Although no certain explanation is available as to why the specified range of diameters is required, the particle diameter limitation seems to relate to the diameters of (commercially) available textile fibers which fall mostly within the range of about 10 to about 30 micrometers. Accordingly, the use of particulate water-insoluble materials having an average diameter of more than about 50 micrometers will not procure the fabric benefits enumerated hereinbefore. On the other hand, the use of particulate water-insoluble materials having an average particle size diameter of less than about 1 micrometer can, under certain circumstances, provide some of the individual advantages referred to hereinbefore but by no means will provide the overall fabric benefits as can be obtained from the conventional use of the compositions as claimed.

The substantially water-insoluble particulate component is further characterized by an anisotropy (axial ratio) of about 5:1 to 1:1. The determination of particle size can be based on the measurement of the projection area of the water-insoluble particle or on the linear measures of this projection area. Or, in other words, the loose particle resting on its surface of maximum stability, the long and intermediate axis are normally horizontal and the short axis vertical. In that context, the term "long axis" represents the maximum overall length of the particle; "intermediate axis" stands for the maximum dimension of a particle in a direction perpendicular to the long axis; whereas "short axis" represents the maximum dimension in a direction perpendicular to the plane containing the long and intermediate axis. The meaning of anisotropy represents the ratio of long axis to short axis for a specific particulate material. Preferred for use in the compositions of this invention are particulate materials having an anisotropy within the range from about 3:1 to about 1.1:1.

See also: Advances in OPTICAL and ELECTRON MICROSCOPY, Vol. 3, R. Barer and V. E. Cosslett, ACADEMIC PRESS 1969, London and New York, incorporated herein by reference.

The essential particulate component for use herein has a hardness of less than about 5.5 on the Moh scale. The hardness as so measured is a criterion of the resistance of a particular material to crushing. It is known as being a fairly good indication of the abrasive character of a particulate ingredient. Examples of materials arranged in increasing order of hardness according to the MOH scale are as follows: h(hardness)-1:talc; dried filter-press cakes, soap-stone, waxes, aggregated salt crystals; h-2: gypsum, rock salt, crystalline salt in general, barytes, chalk, brimstone; h-4: fluorite, soft phosphate, magnesite, limestone; h-5: apatite, hard phosphate, hard limestone, chromite, bauxite; h-6: feldspar, ilmenite, hornblendes; h-7: quartz, granite; h-8: topaz; h-9: corrundum, emery; and h-10: diamond.

Suitable particulate materials have a hardness of less than about 5.5 on the Moh scale. Although some fabric care benefits can be obtained from particulate materials having a Moh hardness of, for example 7, as regards overall benefits, said particulate materials do not qualify for use in the instant compositions. Apparently, excessive particle hardness causes fiber and yarn damage which adversely affect the fabric, particularly through cumulative action resulting from multicycle laundering and washing operations.

The substantially water-insoluble particulate material has a melting point above about 150° C (300° F). Particulate materials having a melting point below that temperature do not provide the fabric benefits because of their tendency to melt in the course of ironing and accordingly spread through the fabric thereby giving body to the fabric which is commonly known as sizing. This is per se undesirable in the context of this invention and the particulate materials must be such as to maintain under ironing conditions, i.e., around 150° C, their integrity and shape as said characteristics are essential for the attainment of the fabric care benefits derivable from the use of the compositions of the instant invention.

In addition, the particulate material must be substantially water-insoluble as its function in the context of the present invention depends upon its integrity, shape, firmness, etc. as described in detail hereinbefore. It should be recognized, however, that minor parts of the particulate ingredient, for example, less than 20%, can be water dispersible and/or water soluble without markedly decreasing the performance advantages.

The water-insoluble particulate materials are substantially free of exchangeable calcium and magnesium ions. Apparently, the presence of exchangeable alkaline earth metal ions such as calcium and magnesium in the particulate materials increases their hydrophilic properties. This results in enhanced swellability characteristics, which, in turn, constitute an obstacle to the uniform and stable enmeshing of particulate material within the fiber structure. As a result, particulate materials having exchangeable calcium and magnesium ions in their structure may contribute to the attainment of some fabric-care benefits, but detract from attaining overall fabric benefits as described hereinabove.

Particularly preferred for use in the instant compositions are starch derivatives such as surface-modified starches bearing hydrophobic moieties which have been reacted with the starch molecule to form ester and ether linkages. As a result of its chemical modification, this starch derivative is water-repellent and accordingly substantially water-insoluble. Such starch derivatives are commercially available under the tradename DRY-FLO from National Starch Products Co. DRY-FLO starches have an average particle size diameter of about 9–11 micrometers.

Additional substantially water-insoluble particulate materials suitable for use in the compositions of the instant invention include:

| Ingredient | Melting Point | Average Particle Size μm | Range Particle Size μm |
|---|---|---|---|
| -poly(methylmethacrylate) $H(CH_2CH(C(=O)OCH_3))_nH$ | 160° C (-isotactic form)<br>200° C (syndiotactic form) | 18<br>18 | —<br>— |
| -poly(tetrafluorethylene) $F(-CF_2CF_2-)_nF$ (1)<br>(2) | 327 - 330° C<br>— | 10<br>10 | —<br>— |
| -polystyrene $H(-CH_2CH(C_6H_5)-)_nH$ | 240 - 250° C | — | 14 - 16 |
| -poly(styrenedivinylbenzene) (3) | — | 6 | 5 - 14 |
| $H(-CH_2CH(C_6H_5)CH_2CH(C_6H_5)CHCH_2-)_nH$ | — | 40 | 25 - 50 |
| -poly(vinyltoluene) (3) $H(-CH_2CH(C_6H_4CH_3)-)_nH$ | meta = 215° C<br>ortho = 360° C | —<br>— | } 5 |
| -poly(melamineformaldehyde-ureaformaldehyde) | thermo-setting | 5 | — |
| -poly(ureaformaldehyde) $H(-OCH_2NH-C(=O)-HNCH_2)_nH$ | thermo-setting | 6 | — |
| -fine glass microballoons (ECCOSPHERES) (4) | | 8 | 5 - 15 |
| -glass beads PF 12-R (coated) (5) | | 17 | 5 - 45 |
| -glass beads PF-11 (5) | | 30 | 10 - 50 |
| -glass beads (unispheres) (5) | | 22 | 15 - 37 |
| -glass microballoons (ECCOSPHERES IG) (4) | | 30 | — |
| -glass beads PF-12 (5) | | 17 | 5 - 44 |
| -glass beads PF-12S (5) | | 17 | — |

(1) Teflon® DuPont de Nemours;
(2) Molykote 522 (Dow-Corning);
(3) Dow-Corning
(4) Emerson & Cuming; Canton, Mass.
(5) Cataphote Corp.; Jackson, Miss.
See also:
(1) Technical Data Sheet for "Teflon" 7A; and brochure re "Typical Properties Common to All Granular Teflon FFE-Fluorocarbon Resins", No.A-43044; both being issued by DuPont de Nemours; (2) Catalog of Small Glass Beads, issued by Microbeads Division, Cataphote Corporation, Jackson, Mississippi; particularly documents MB-111-DS-5/72; MB-IV-DS-5/72; MB-V-LP-5/72; and MB-VII-LP-5/72; and (3) Technical Information Brochure concerning ECCOSPHERES®, hollow glass and ceramic microspheres, MICROBALLOONS, issued by Emerson & Cuming, Inc., Canton, Massachusetts; the above documents being hereby incorporated by reference.

Another substantially water-insoluble particulate component for use in the instant compositions is a starch granule having, in addition to the essential parameters as defined in the claims, a swelling power of less than about 15 at a temperature of 65° C. Modification of the starch granules in a matter such as to render it more soluble by gelatinizing, derivatizing, or degrading is to be avoided to the extent it leads to starches which can lose their firm shape and also do not qualify for use in the present invention. Soluble or gelatinizable starches having a swelling power of more than about 15 at 65° C are less suitable as they tend to lose their individual shape and consequently run into the fiber which, in turn, leads to undesirable stiffness of fabrics.

The swelling power is determined according to the method set forth in Cereal Chem., 36, pp. 534–544 (1959) Harry W. Leach, et al. Ten grams of starch is suspended in 180 ml. of distilled water in a tared 250-ml. centrifuge bottle. The suspension is mechanically stirred with a small stainless-steel paddle (0.75-in. wide, 1.5-in. high) at a rate just sufficient to keep the starch completely suspended (i.e., 200 r.p.m.) This low speed avoids shearing the fragile swollen granules and consequent solubilization of the starch. The bottle is lowered into a thermostatted water bath maintained at a temperature of 65° C (±0.1° C) and held for 30 minutes, slow stirring being continued during this period. The bottle is then removed, wiped dry, and placed on the torsion balance. The stirrer is removed and rinsed into the bottle with sufficient distilled water to bring the total weight of water present to 200.0 g. (including the moisture in the original starch). The bottle is stoppered, mixed by gentle shaking, and then centrifuged for 15 minutes at 2200 r.p.m. (i.e., 700 times gravity). The clear supernate is carefully drawn off by suction to within ¼ in. of the precipitated paste. An aliquot of this supernate is evaporated to dryness on the steam bath and then dried for 4 hours in the vacuum oven at 120° C. The percentage of solubles extracted from the starch is calculated to dry basis. The remaining aqueous layer above the sedimented starch paste is then siphoned off as quantitatively as possible. The bottle and paste are reweighed on the torsion balance, and the swelling power calculated as the weight of sedimented paste per g. of dry-basis starch.

Starches having a swelling power of more than 15 at 65° C are not suitable for use in the instant composition. Although the final choice of starch which will meet requirements of this invention depends upon the origin of the material and also upon process conditions such as bleaching, degradation, and isolation applied to a given species, suitable starches can, for example, be obtained from corn, wheat, and rice. Current potato and tapioca starches have a swelling power exceeding 15 at a temperature of 65° C and, therefore, are not suitable for being used in the compositions of this invention. More complete information concerning water-insoluble starches, the processes for their preparation and isolation from a variety of raw materials are well known [see, for example: THE STARCH INDUSTRY, Knight, J. W., Pergamon Press, London (1969)].

As explained hereinafter, however, without being limited as a result thereof, it is thought that the parameters of the particulate material for use in the instant compositions are essential to the extent that said characteristics directly contribute to the beneficial fabric properties.

These critical limitations as to the nature of the particulate material were determined initially by actual experimentation. While applicants will not be held by any theoretical interpretation of these critical limitations, it appears that the particulate material interacts with the textile material at the fiber level to impart the above enumerated benefits to the textile fabric as a whole. In this respect it is to be noted that textile materials consist essentially of assemblies of fine flexible fibers arranged in more or less orderly geometrical arrays. Individual fibers within the assembly are usually in a bent or twisted configuration and are in various states of contact with neighboring fibers. When the assembly is deformed the fibers more relative to each other and this relative motion accounts to a large extent for the characteristic flexibility of textile materials. To what extent a given textile material will recover when a deforming force is removed is largely determined by the nature of the interaction of the individual fibers making up the textile material. Textile fibers are viscoelastic and hence will exhibit delayed recovery from strain. However, the large number of interfiber contact points provide frictional restraints which further hinder the recovery process. In most textile structures the area of interfiber contact is probably less than 1% of the total fiber area. The force per contact point is generally estimated to be within the range of 1 to 10 dynes.

It is with this view of textile materials that applicants hypothesis going to explain the efficacy of particulate materials in imparting the related effects of anti-wrinkling, ease of ironing, softness, anti-static benefits and appearance improvements can be appreciated. For purpose of conceptualization, this hypothesis will hereinafter be referred to as the "ball bearing effect". The conceptualization is useful in interpreting the interaction of the particulate material and the textile matrix under imposed forces of deformation.

By means of microscopic analysis and straining techniques, it has been determined that textile fabrics treated in accordance with the present invention are characterized by having discrete particulate materials intimately dispersed, in a substantive fashion, in the interstices of the fiber matrix. It is believed that these particulate materials, so interfiberly positioned, act in the manner of ball bearings to reduce interfiber forces during formation of the textile fabric as a whole. The gross effect is the enchancement of viscoelastic recovery (anti-wrinkling effect) and diminution of the forces operable at interfiber contact points (ease of ironing effect). Under this conceptualization, and as already referred to hereinabove, the particle diameter limitation is appreciated since most commercially available textile fibers have diameters which fall within the range of about 10 to about 30 micrometers. Therefore, to be effective, the particulatematerial of the invention must preferably be comparable to the textile fiber diameters.

The above-mentioned benefits are similary related to the presence of the particulate material at points within interstices of individual fiber yarns. Microscopic examination of textile yarns in cross section reveals that textiles treated in accordance with the present invention have greater yarn diameters than similar textile yarns which are distinguishable by the absence of particulate materials. Apparently, the particulate materials positioned in the interfiber spaces effectively open up the yarn (apparent increase in bulk) resulting in a softer, fluffier textile fabric. The anti-static benefit appears to be related to a change in a resistivity of the fabric matrix containing the particulate materials; for example, the copresence of chemically modified starch granules such as DRY-FLO starch, in the textile fabric increases the equilibrium moisture content of the matrix, thereby decreasing its resistivity and diminishing static build-up.

The paticulate material can be admixed with a previously prepared detergent, or can be sprayed onto a previously prepared detergent formulation just prior to packaging. But in every case, the admixing step is subsequent to any step, for example, heating, which might alter the native granular integrity of the particulate material.

Detergent builder salts can also advantageously be employed in the compositions of the present invention. Suitable builder salts can be inorganic or organic in nature and can be selected from a wide variety of known builder salts; said builders are normally used in an amount from about 10% to about 60%, preferably from about 10% to about 40%. The weight ratio of organic surface-active agent to detergent builder salt is normally from about 20:1 to 1:20, and preferably from 10:1 to 1:10. Suitable alkaline, inorganic builder salts include alkali metal carbonates, aluminates, phosphates, polyphosphates and silicates. Specific examples of these salts are sodium or potassium tripolyphosphates, aluminates, carbonates, phosphates and hexamethaphosphates. Suitable organic builder salts include the alkali metal, ammonium and substituted ammonium polyphosphonates, polyacetates, and polycarboxylates.

The polyphosphonates specifically include the sodium and potassium salts of ethylene diphosphonic acid, sodium and potassium salts of ethane-1-hydroxy-1,1-diphosphonic acid and sodium and potassium salts of ethane-1,1,2-triphosphonic acid. Other examples include the water-soluble [sodium, potassium, ammonium and substituted ammonium (substituted ammonium, as used herein, includes mono-, di-, and triethanol ammonium cations)] salts of ethane-2-carboxy-1,1-diphosphonic acid, hydroxymethanediphosphonic acid, carbonyldiphosphonic acid, ethane-1-hydroxy-1,1,2-triphosphonic acid, ethane-1-hydroxy-1,1,2-triphosphonic acid, propane-1,1,3,3-tetraphosphonic acid, propane-1,1,2-3-tetraphosphonic acid. Examples of these polyphosphonic compounds are disclosed in British Pat. Nos. 1,026,366; 1,035,913; 1,129,687; 1,136,619; and 1,140,980.

The polyacetate builder salts suitable for use herein include the sodium, potassium lithium, ammonium, and substituted ammonium salts of the following acids; ethylenediaminetetraacetic acid, N-(2-hydroxyethyl)-ethylenediaminetriacetic acid N-(2-hydroxyethyl)-nitrilodiacetic acid, diethylenetriaminepentaacetic acid, 1,2-diaminocyclohexanetetraacetic acid and nitrilotriacetic acid. The trisodium salts of the above acids are generally preferred.

The polycarboxylate builder salts suitable for use herein consist of water soluble salts of polymeric aliphatic polycarboxylic acids as, for example, described in U.S. Pat. No. 3,308,067 to F. L. Diehl, patented Mar. 7, 1967; this patent being hereby incorporated by reference.

Preferred detergent builder salts for use in the compositions of the instant invention include the watersoluble salts of: (1) amino polycarboxylates; (2) ether polycarboxylates; (3) citric acid; and (4) aromatic polycarboxylates derived from benzene. These preferred detergent builder salts are preferably used in an amount from about 10% to about 40%.

The water-soluble amino-polycarboxylate compounds have the structural formula

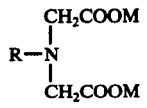

wherein R is selected from:

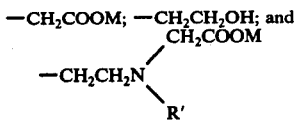

wherein R′ is

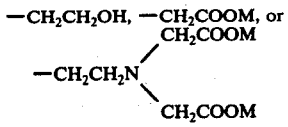

and each M is selected from hydrogen and a salt-forming cation.

These materials include the water-soluble aminopolycarboxylates, e.g., sodium and potassium ethylenediaminetetraacetates, nitrilotriacetates and N-(2-hydroxyethyl)nitrilodiacetates. Especially preferred are water-soluble salts of nitrilotriacetic acid.

The water-soluble "ether polycarboxylates" have the formula:

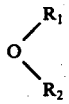

wherein $R_1$ is selected from:

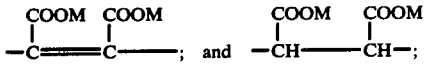

and $R_2$ is selected from:

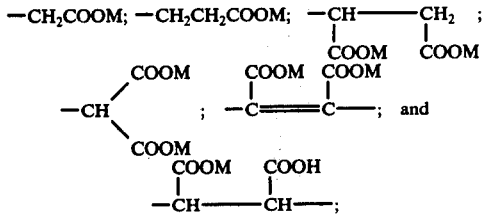

wherein $R_1$ and $R_2$ form a closed ring structure in the event said moieties are selected from

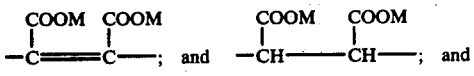

each M is selected from hydrogen and a salt-forming cation.

Specific examples of this class of carboxylate builders include the water-soluble salts of oxydiacetic acid having the formula

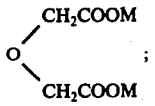

oxydisuccinic acid having the formula

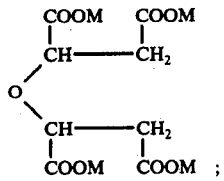

carboxy methyl oxysuccinic acid having the formula

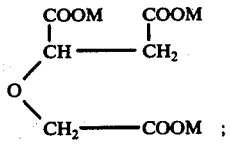

furan tetracarboxylic acid of the formula

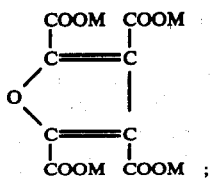

and tetrahydrofuran tetracarboxylic acid having the formula

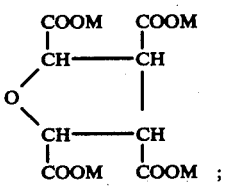

The salt-forming cation M can be represented, for example, by alkali metal cations such as potassium, lithium and sodium and also ammonium and ammonium derivatives.

Water-soluble polycarboxylic builder salts derived from citric acid constitute another class of a preferred builder for use herein. Citric acid, also known as 2-hydroxy-propane-1,2,3-tricarboxylic acid, has the formula

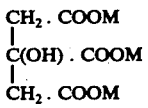

Citric acid while it occurs in free state in nature, large quantities of it are produced, for example, as by-product of sugar departing from sugar beets. For use in the compositions of this invention, it can be desirable to use the acid and partially neutralized species whereby the neutralizing cation is preferably selected from alkali metal ions such as sodium, potassium, lithium and from ammonium and substituted ammonium such as mono-, di-, and trimethylolammonium and also mono-, di-, and triethanolammonium cations.

Water-soluble salts of mellitic acid, benzenepentacarboxylic acid and mixtures thereof constitute another class of preferred polycarboxylate builders for use in the subject compositions.

A particular aspect of the present invention encompasses a method of simultaneously cleansing and imparting beneficial characteristics to fabrics. To that end, suitable treating liquors will normally contain:

| | In parts per million (ppm) of treating liquor | | |
|---|---|---|---|
| | | Preferred | Especially Preferred |
| Organic surface-active agent | 10–10,000 | 40–6,000 | 60–4,000 |
| Particulate material | 0.2–1,000 | 1–600 | 2–400 |

The organic surface-active agent and particulate material species suitable for being used in the method embodiment are identical to those which fit the requirements of the composition aspects of this invention; said species are described in great detail hereinbefore.

In a preferred method aspect, fabrics are treated in an aqueous liquor comprising, in addition to the essential organic surface-active agents and particulate material referred to hereinbefore, as well as from about 50 ppm to about 6000 ppm, preferably from about 50 ppm to 4000 ppm of a detergent builder salt.

The aqueous washing liquor used for carrying out the method of this invention can, for example, be prepared by adding to a substantially aqueous medium, laundry formulations corresponding to the detergent compositions encompassed in this invention. Similar results are obtained, however, by adding the individual ingredients to an aqueous medium. As an example thereof, one can add to the aqueous medium a granular detergent composition containing all ingredients except the particulate material which is added separately. It is also possible to prepare a detergent composition containing actives and other usual ingredients, adding the particulate material in combination with fillers such as sodium sulfate or with builders such as sodium carbonate.

In the foregoing, the essential ingredients which are contained in the detergent formulations of this invention are described in detail. Other optional components such as detergent builder salts have been described in detail as well. In addition to said ingredients, however, in the finished detergent formulations of this invention, there can be added major amounts of other optional detergent composition ingredients which make the product more effective and more attractive. So, for example, organic and inorganic peroxy bleach compounds can be incorporated in these compositions in an amount from about 5% to about 40%.

The peroxy bleach compound can be any of the usual inorganic and organic ingredients which are known to be satisfactory for being incorporated for that purpose in detergent compositions. Examples of inorganic peroxy bleach compounds are the alkali metal salts of perborates, percarbonates, persilicates, persulfates, and perphosphates. As is well known, the perborates can have different degrees of hydration. Although frequently the tetra hydrate form is used, it is for certain purposes desirable to incorporate perborates having a lower degree of hydration water, for example, one mole, two moles, or three moles. Organic peroxy bleach agents may be used as well. The like ingredients can be incorporated as such, i.e., they have been prepared previously or they may be prepared in situ through the addition of, for example, any peroxy bleach agents suitable for being used in combination with an organic peroxy bleach activator.

Specific examples of the organic peroxy bleach compounds are the water-soluble salts of mono- and diperoxy acids such as perazelaic acid, monoperoxy phthalic acid, diperoxy terephthalic acid, 4-chlorodiperoxyphthalic acid. Preferred aromatic peracids include the water-soluble salts of diperiosphthalic acid, m-chloroperbenzoic acid and p-nitroperbenzoic acid.

In the event the peroxy bleach compound is to be prepared in situ, then its precursors, i.e., the peroxy bleach agent and peroxygen activators are to be added separately to the detergent composition. The peroxygen bleach can be repesented by all oxygen bleaching agents which are commonly used in detergent technology, i.e., organic and inorganic species, as mentioned hereinbefore. The activating agents can be represented by all oxygen activators known as being suitable for use in detergent technology. Specific examples of the preferred activators include acylated glycoluriles, tetra-acetyl methylene diamine, tetra-acetyl ethylene diamine, triacetyl isocyanurate and benzoylimidazole. Acid anhydride activators which bear at least one double bond between carbon atoms in $\alpha,\alpha^1$ to the carbonyl group of the anhydride radical can be used as well. Examples thereof are phthalic and maleic anhydrides.

In the event the peracid is prepared in situ, then the molar ratio of peroxygen bleach agent to bleach activator shall preferably be in the range from about 5:1 to 1:2, especially from 2:1 to 1:1.2.

Other detergent composition ingredients used herein include suds regulating agents such as suds boosters and suds suppressing agents, tarnish inhibitors, soil suspending agents, buffering agents, additional enzymes, brighteners, fluorescers, perfumes, dyes and mixture. The suds boosters can, e.g., be represented by diethanolamides. Silicones, hydrogenated fatty acid, and hydrophobic alkylene oxide condensates can be used in the like compositions for suds suppressing purposes or, more generally, for suds regulating purposes. Benzotriazole an ethylenethiourea can be used as tarnish inhibitors. Carboxymethyl cellulose is a well-known soil suspending agent. In addition to the initial proteolytic constituents, different enzymes such as amylase can be added as well. The above additional ingredients, when used in the instant compositions, are employed in the usual conventional concentrations.

As indicated earlier, there is no criticality as to combining the above-mentioned components in preparation of the detergent compositions of this invention other than the requirement that the particulate component ultimately be represented in discrete granular form in the environment of the laundering liquor. As mentioned earlier, if the composition is in granular or flaked form, the particulate material is merely admixed in dry form or sprayed on from a non-heated aqueous dispersion. In detergent compositions of liquid form, the particulate ingredients are likewise merely added in proper proportion.

In order to evaluate the detergent compositions of the present invention, it was necessary to perform certain tests upon textile fabrics treated in accordance with the present invention. The manner of these tests is set forth below.

Anit-Static Test

A bundle of mixed fabrics (ca. 53% all-cotton; 12% 65/35 polyester/cotton blend; 17% nylon; 18% Dacron) is washed for 10 minutes in a miniature agitator washer containing two gallons of aqueous washing liquor containing the test laundry compositions (as set forth below). The laundering temperature is 100° F; water hardness 7 grains/gallon artificial hardness. The bundle comprises 5% by weight of the washing liquor. The bundle is spun dry and rinsed for 2 minutes in 2 gallons of water at 100° F and 7 grains/gallon hardness. The fabrics are then dried in a commercial dryer.

The static charge on each fabric is then measured by a standard electrostatic technique within a Faraday cage. The sum of the absolute values of the charges on all fabrics in the bundle, divided by the sum of the area (yards$^2$) of the total fabric surface (2) sides of the fabric ) is then computed. This so-called "static value" (volts/yard2) correlates with gross observations of the effects of static charges on fabric surfaces, i.e., electrical shocks, sparks, fabric clinging, etc. Depending on the fabric bundle tested, no static clinging is exhibited by fabrics having a static value less than about 1.5 volts/yards$^2$; substantial static clinging is noted in fabrics having a static value above 4.5 volts/yard$^2$.

Anti-Wrinkling Test

A bundle of mixed fabrics (ca. 53% all-cotton; 12% 65/35 polyester/cottom blends; 17% nylon; 18% Dacron) is washed for ten minutes in a miniature agitator washer containing 2 gallons of aqueous washing liquor containing the test laundry compositions (as set forth below). The laundering temperature is 100° F; water hardness 7 grains/gallon artificial hardness. The bundle is spun dried and rinsed for 2 minutes in 2 gallons of water at 100° F and 7 grains/gallon hardness. The fabrics are then dried in a commercial dryer.

The extent of wrinkling on a given piece of fabric is then measured by mounting the fabric on a flat, movable surface within a light-tight box. A fine beam of light from a source above the fabric impinges upon the fabric at an angle of 90°. As the mounted fabric is moved through a predetermined distance, a miniature photocell affixed adjacent to the stationary light source responds to scattered light at an angle of 45° to the fabric surface. A plot of the light intensity measured by the photocell versus the length of the fabric path transversed gives a profile (curve) which is in all practical respects a facsimile of the surface of the test fabric. That is, a smooth, unwrinkled fabric gives essentially a straight line of constant light intensity; whereas a wrinkled fabric gives a series of peaks and minima. The ratio of the absolute distance through which the fabric was moved to the length of the plotted curve is quantitatively related to the extent of wrinkling.

Ease of Ironing Test

A bundle of mixed fabrics (ca. 53% all-cotton; 12% 65/35 polyester/cotton blends; 17% nylon; 18% Dacron) is washed for ten minutes in a miniature agitator washer containing two gallons of aqueous washing liquor containing the test laundry compositions (as set forth below). The laundering temperature is 100° F; water hardness 7 grains/gallon artificial hardness. The bundle comprises 5% by weight of the washing liquor. The bundle is spun dry and rinsed for 2 minutes in two gallons of water at 100° F and 7 grains/gallon hardness. The fabrics are then dried in a commercial dryer.

The ease of ironing of each fabric is then measured by using an instrumented, but otherwise conventional, iron. In essence, the iron by means of sensors fitted in its interior measures the amount of effort required by a naive operator to smooth the surface of the test fabric to a subjectively smooth appearance. The total amount of work required to achieve this appearance is a function of the force exerted on the iron (measured) and the distance traversed by the iron in the plane of the fabric (measured). These tests are performed against untreated controls by naive operators.

Other tests such as softness (related to bulkiness), ease of folding, fabric drapability, fragrance and general state of cleanliness were assessed subjectively by expert panelists against unmarked controls.

The laundry detergent compositions and process of the instant invention are illustrated by the following examples.

| BASE COMPOSITION | |
|---|---|
| Ingredient | % by Weight |
| Linear $C_{13}$ alkylbenzene sodium sulfonate | 17 |
| Sodium tripolyphosphate | 50 |
| Sodium silicate solids (ration $SiO_2/Na_2O$ = 2.0) | 6 |
| Sodium sulfate | 15 |
| Particulate material (see below) | 0.1 |
| Minor additives and moisture | Balance to 100 |

The base composition is prepared by admixing all ingredients except the particulate material in a crutcher and spray-drying to form granules. These granules are then uniformly mixed with the particulate material. Said composition is then used, at a 0.12% product concentration, to launder soiled fabrics in standard fashion. The fabrics are cleaned and dried and performance can be appreciated by testing the fabrics for anti-wrinkling and ease of ironing as described hereinbefore. The test fabrics as compared against control fabrics exhibit reduced wrinkling, easier ironing, enhanced softness, reduced static charge and improved appearance.

The following particulate materials when incorporated in the base composition set forth above in the concentration specified provide the advantages described in the proceding paragraph.

| Ex. | Particulate Material | Average Particle Size μm | Melting Point (° C) |
|---|---|---|---|
| I | Glass micro balloons (ECCOSPHERES IC) | 30 | — |
| II | Poly(tetrafluorethylene) (MOLYKOTE 522) | 10 | — |
| III | Poly(ureaformaldehyde) | 6 | Thermo-setting |
| IV | Poly(methylmethacrylate) (syndiotactic) | 18 | 200 |
| V | Glass beads PF-12S | 17 | — |
| VI | Glass beads PF-12T | 17 | — |
| VII | "DRY-FLO" Starch | 10 | — |
| VIII | Poly(melamineformaldehyde-ureaformaldehyde) | 5 | Thermo-setting |
| IX | Glass beads (Unispheres) | 22 | — |
| X | Glass beads PF-12R | 17 | — |
| XI | Poly(styrenedivinylbenzene) | 6 | — |
| XII | Glass beads PF-11 | 30 | — |

Substantially identical results are also obtained when 0.3% of the following particulate materials are used: poly(melamine formaldehyde-ureaformaldehyde) average particle size, 15 μm; poly(styrene-divinylbenzene) average particle size, 6, 10, 16, 20, 25 and 30μm, respectively.

Substantially identical fabric care benefits are also obtained when the anionic surface-active agent of the base composition is replaced with an equivalent amount of 2-acetoxytridecane-1-sulfonic acid; sodium methyl-α-sulfopalmitate; sodium-β-methoxyoctadecyl sulfonate; sodium coconut alkyl ethylene glycoether sulfonate and the sodium salt of the sulfuric acid ester of the reaction product of one mole of tallow fatty alcohol and three moles of ethylene oxide, respectively.

Substantially equivalent softening, anti-wrinkling, ease of ironing, anti-static and appearance benefits are obtained when the anionic surfactant of the base composition is replaced with an equivalent amount of a condensation product of nonylphenol with about 9.5 moles of ethylene oxide per mole of nonylphenol; the condensation product of coconut fatty alcohol with about six moles of ethyleneoxide per mole of coconut fatty alcohol; the condensation product of tallow fatty alcohol with about eleven moles of ethylene-oxide per mole of tallow fatty alcohol; the condensation product of a secondary fatty alcohol containing about 15 carbon atoms with about nine moles of ethyleneoxide per mole of fatty alcohol; 3(N,N-dimethyl-N-alkyl ammonio)propane-1-sulfonate or 3(N,N-dimethyl-N-alkyl ammonio)-2-hydroxy-propane-1-sulfonate wherein in both compounds the alkyl group averages 14.8 carbon atoms in length; 3(N,N-dimethyl-N-hexadecyl ammonio)-propane-1-sulfonate; 3(N,N-dimethyl-N-hexadecyl ammonio)-2-hydroxy propane-1-sulfonate; 3(N-dodecylbenzyl-N,N-dimethylammonio)-propane-1-sulfonate; 3-(N-dodecylbenzyl-N,N-dimethylammonio)acetate; 3-(N-dodecylbenzyl-N,N-dimethylammonio)-propionate; 6-(-dodecyl-benzyl-N,N-dimethylammonio)hexancate; 2-(N,N-dimethyl-N-hexadecylammonio)-acetate; and sodium 3-(dodecylamino)-propane-1-sulonfate, respectively.

Substantially identical results are also abtained in the event the particulate materials and mixture thereof are used at the following concentrations: 0.2%, 0.4%, 0.6%, 0.9%; 1.2%, 1.4%, 2%, 2.6%, 3.5%, 4.2%, 6.0%, 7.5%, and 9.0%.

EXAMPLE XIII

A laundry detergent product is prepared having the following composition:

| Components | Wt. % |
|---|---|
| Sodium Soap(1) | 40.0 |
| Potassium Soap(1) | 11.2 |
| $TAE_3S$(2) | 10.7 |
| $C_{11.8}LAS$(3) | 8.8 |
| Sodium Silicate | 8.9 |
| Sodium Sulfate | 11.9 |
| Modified cornstarch ("DRY-FLO") | 1.0 |
| Miscellaneous including moisture | Balance |

(1)Soap mixture comprising 90% tallow and 10% coconut soaps.
(2)Sodium salt of ethoxylated tallow alkyl sulfate having an average of about 3 ethylene oxide units per molecule.
(3)Sodium salt of a linear alkyl benzene sulfonate having an average alkyl chain length of about 12 carbon atoms.

The foregoing ingredients, except the "DRY-FLO" starch are mixed in a crutcher and spray dried to provide a granular, soap based composition. To this soap based composition is added 1.0 wt. % of "DRY-FLO" starch having an average particle diameter of 10 micrometers.

The foregoing composition is added to an aqueous laundering liquor at 100° F at a concentration of about 0.12 wt. %. The composition rapidly dissolves and the "DRY-FLO" starch granules are uniformly and independently dispersed throughout the laundering liquor. Fabrics laundered in said liquor are concurrently cleansed, and benefited with respect to wrinkling, ease of ironing, softness, anti-static and appearance as determined by, among others, the before-mentioned tests against control fabrics laundered exactly as above except in the absence of the starch component.

Substantially identical results are obtained when the "DRY-FLO" starch is replaced with an equivalent amount of a particulate material selected from glass micro balloons (ECCOSPHERES IG); poly(tetrafluorethylene) (MOLYKOTE 522); poly(ureaformaldehyde); poly(methylmethracrylate)(syndiotactic); glass beads PF-12S; glass beads PF-12T; poly(melamineformaldehyde-ureaformaldehyde); glass beads (Unispheres); glass beads PF-12R; poly(styrenedivinylbenzene); glass beads PF-11; said particulate materials having average particle size diameters and melting point as indicated in Examples I–XII.

EXAMPLE XIV

A detergent composition is prepared having the following composition:

| Components | Parts |
|---|---|
| Sodium tallow alkyl trioxy ethylene sulfate | 20 |
| Poly(methylmethacrylate); Mp = 200° C; av. particle size: 18 μm | 2 |
| Sodium oxydisuccinate | 20 |
| Sodium perborate | 20 |
| Sodium sulfate | 10 |
| Minor ingredients and moisture | 6 |

The above composition provides excellent cleaning and outstanding fabric conditioning properties to textiles laundered therein.

Substantially identical results are obtained when sodium tallow alkyl trioxethylene sulfate is replaced with an equivalent quantity of sodium coconut alkyl ethylene gylcol ether sulfate; sodium tallow alkyl gylcol ether sulfate; sodium tallow alkyl pentaoxyethylene sulfate; ammonium tetradecylpentaoxy ethylene sulfate; ammonium lauryl hexaoxyethylene sulfate; sodium tallow alkyl hexaoxyethylene sulfate; and also the Alkyl Ether Sulfate Mixtures Nos. I, II, III, and IV from Table I.

Substantially similar results are also obtained in the event the sodium tallow alkyl trioxyethylene sulfate is substituted by an equivalent amount of an α-olefin sulfonate having from 12 to 24 carbon atoms and which have been prepared by means of uncomplexed sulfurdioxide as described in U.S. Pat. No. 3,322,880, Adriaan Kessler, et al.

EXAMPLE IV

A through-the-wash-cycle fabric conditioning additive having the following composition is prepared:

| Components | Parts |
|---|---|
| Sodium bicarbonate | 19.5 |
| "DRY-FLO" starch (average particle size 10 μm) | 0.5 |
| Sodium sulfate | 20.0 |

This additive is used for treating textiles in combination with a detergent base granule having the following composition.

| Components | Parts |
|---|---|
| Sodium linear dodecyl benzene sulfonate | 6 |
| Sodium silicate solids (ratio $SiO_2/Na_2O$ = 2.0) | 12 |
| Sodium carbonate | 12 |
| Sodium sulfate | 28 |
| Minors | 2 |

The conditioning additive is either combined with the detergent base granule prior to dissolving said mixture in the washing liquor or is added separately to the washing liquor. In both cases, the product concentration, based on the sum of both, is 0.12% by weight, representing 0.05% by weight of conditioning additive and 0.07% by weight of detergent base granule.

Fabrics treated with the laundering liquor of this invention exhibit superior fabric properties relative to what is obtained from a similar method containing equivalent concentration of a detergent composition known in the art.

What is claimed is:

1. A detergent composition in particulate form having fabric conditioning properties, consisting essentially of:

a. from about 2% to about 99.5% by weight of an organic surface-active agent selected from the group consisting of anionic, nonionic, zwitterionic and ampholytic detergents and mixtures thereof; and b. from about 0.05% to about 10% by weight of a substantially water-insoluble particulate material having:

i. an average particle size in the range from about 5 to about 30 micrometers;

ii. a shape having an anisotropy of about 5:1 to 1:1;

iii. a hardness of less than about 5.5 on the Moh scale;

iv. a melting point above about 150° C; and v. substantial freedom from exchangeable calcium and magnesium ions, said water-insoluble particulate material being selected from the group consisting of glass beads, glass beads, glass microballoons, ceramic beads, and mixtures thereof.

* * * * *